US012054961B2

(12) United States Patent
Zeng

(10) Patent No.: US 12,054,961 B2
(45) Date of Patent: Aug. 6, 2024

(54) BEACH SUNSHADE

(71) Applicant: Xianrui Zeng, Foshan (CN)

(72) Inventor: Xianrui Zeng, Foshan (CN)

( * ) Notice: Subject to any disclaimer, the term of this patent is extended or adjusted under 35 U.S.C. 154(b) by 0 days.

(21) Appl. No.: 18/489,862

(22) Filed: Oct. 19, 2023

(65) Prior Publication Data

US 2024/0044168 A1 Feb. 8, 2024

(51) Int. Cl.

| | |
|---|---|
| ***E04H 15/58*** | (2006.01) |
| ***E04H 15/44*** | (2006.01) |
| ***E04H 15/60*** | (2006.01) |
| *E04H 15/02* | (2006.01) |
| *E04H 15/32* | (2006.01) |
| *E04H 15/54* | (2006.01) |
| *E04H 15/56* | (2006.01) |
| *E04H 15/62* | (2006.01) |

(52) U.S. Cl.

CPC ..... *E04H 15/58* (2013.01); *E04H 15/44* (2013.01); *E04H 15/60* (2013.01); *E04H 15/02* (2013.01); *E04H 2015/328* (2013.01); *E04H 15/54* (2013.01); *E04H 15/56* (2013.01); *E04H 15/62* (2013.01)

(58) Field of Classification Search

CPC ..... E04H 15/003; E04H 15/58

See application file for complete search history.

(56) References Cited

U.S. PATENT DOCUMENTS 1,650,111 A * 11/1927 Byne ..... E04H 15/003 135/120.2
2,036,033 A * 3/1936 Fisher ..... E04H 15/56 5/418
2,660,186 A * 11/1953 Marshall ..... E04H 15/003 135/153
2,848,756 A * 8/1958 McCann ..... E04H 15/003 52/63
3,042,053 A * 7/1962 Gabriel ..... E04H 15/003 135/130
3,070,107 A * 12/1962 Beatty ..... E04H 15/003 D30/118
3,075,536 A * 1/1963 Parker ..... E04H 15/003 D21/837

(Continued)

FOREIGN PATENT DOCUMENTS

DE 202019104428 U1 * 10/2019 ..... E04H 15/003
KR 20200067553 A * 6/2020

*Primary Examiner* — David R Dunn
*Assistant Examiner* — Danielle Jackson
(74) *Attorney, Agent, or Firm* — Zhigang Ma

(57) ABSTRACT

This invention falls within the domain of beach sunshade technology and introduces a beach sunshade. It comprises a sunshade cover, in which crossbar is internally mounted, with vertical poles fixed at both ends of the crossbar. This particular type of beach sunshade utilizes a combination of a crossbar, vertical poles, fasteners, connecting ropes, sandbags, connecting rods, securing rings, and insertion rods to ensure a more stable setup when placed on the beach. First, the internally mounted crossbar and vertical poles provide essential support, enabling the sunshade cover to maintain its width effectively. Then, the external surface of the crossbar allows for the secure attachment of a connecting rod. The connecting rod, in turn, firmly hold the securing ring on their external surfaces.

4 Claims, 1 Drawing Sheet

(56) References Cited

U.S. PATENT DOCUMENTS 4,930,534 A * 6/1990 Hill ..... E04H 15/003 135/117
5,080,123 A * 1/1992 Stein ..... E04H 15/003 135/900
5,546,971 A * 8/1996 Leonhardt ..... E04H 15/003 135/909
5,964,237 A * 10/1999 Lin ..... A45B 19/08 285/302
6,618,988 B2 * 9/2003 Williams ..... A01G 9/16 47/17
6,953,180 B1 * 10/2005 Ruvalcaba ..... E04H 12/2269 248/530
7,406,977 B1 * 8/2008 Shires ..... E04H 15/26 135/121
7,789,097 B1 * 9/2010 Sotirkys ..... E04H 15/06 135/88.01
8,978,676 B2 * 3/2015 Williams ..... E04H 12/22 248/156
9,051,756 B1 * 6/2015 Jenkins ..... E04H 15/58
9,903,134 B2 * 2/2018 Munnerlyn ..... E04H 15/001
10,190,330 B2 * 1/2019 Barnes ..... E04H 15/30
10,767,385 B2 * 9/2020 Wehr ..... E04H 12/2238
11,596,211 B2 * 3/2023 James ..... E04H 15/58
11,686,120 B1 * 6/2023 Yates ..... E04H 15/44 135/143
2010/0243010 A1 9/2010 Zweideck
2012/0049563 A1 3/2012 Haase
2012/0291830 A1 * 11/2012 Crimi ..... E04H 15/58 135/117
2014/0041703 A1 * 2/2014 Funston ..... E04H 15/54 135/121
2019/0338527 A1 11/2019 Yamaji et al.
2023/0126867 A1 * 4/2023 Barnes ..... E04H 15/64 135/121
2023/0151636 A1 * 5/2023 Li ..... E04H 15/58 135/98

* cited by examiner

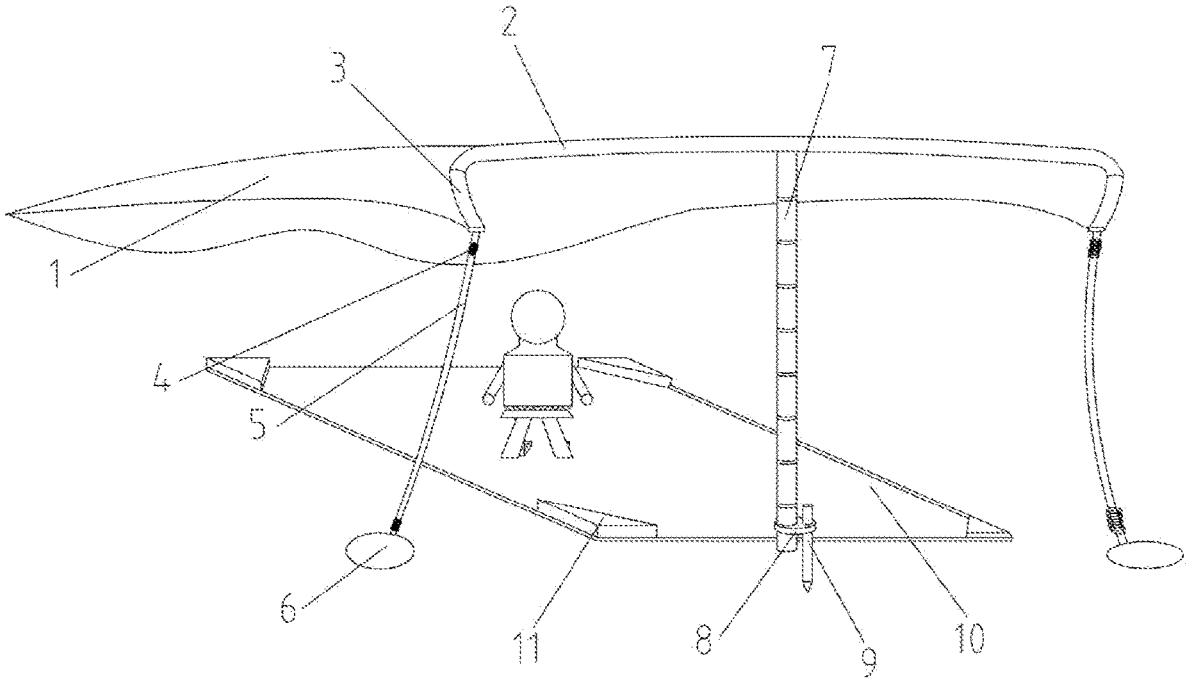
2
3
7
1
4
5
6
11
8
9
10

BEACH SUNSHADE

TECHNICAL FIELD

This invention relates to the field of beach sunshade technology, specifically, a beach sunshade canopy.

BACKGROUND TECHNOLOGY

Sunshades are designed to block sunlight and heat from entering through windows, offering excellent sun-blocking effects and a fresh style. Outdoor sunshade series can be categorized into sunshade canopies, tent series, sun umbrella series, fixed canopy series, combined ceiling canopies, aluminum alloy combined canopy structures, and car canopy series. Sunshade canopies further include curved-arm sunshade canopies, awning canopies, and window canopies. Sunshades find wide practical use, including providing shade at the beach for enhanced recreational experiences.

However, in practical use, certain issues persist. Existing beach sunshades often struggle to provide stable placement on sandy beaches, leading to tilting problems during use. This, in turn, affects the user's experience and diminishes their effectiveness in real-world scenarios, making them less conducive to widespread adoption. To address these challenges, this invention introduces a beach sunshade.

Invention Content

In view of the shortcomings of the existing technology, the present invention provides a beach sunshade that offers enhanced stability when used on the beach, addressing the issues outlined in the background technology.

The invention offers the following technical solution: a beach sunshade which comprises a sunshade cover. Inside the sunshade cover, a crossbar is installed, with vertical poles fixed at both ends of the crossbar. Through the action of the crossbar and vertical poles, the sunshade cover can be supported during practical use, thereby providing more shading space.

Optimally, the external surface of the crossbar is fixedly equipped with a connecting rod, and the external surface of the connecting rod is fixedly equipped with a securing ring, with an insertion rod installed inside the valleys of the securing ring. During practical use, the insertion rod can be inserted into the sand on the beach, ensuring the vertical stability of the entire sunshade, making it more efficient to use in practice.

Optimally, one end of the vertical poles is equipped with a fastener, and the inside of the fastener is connected to a connecting rope, with one end of the connecting rope connected to sandbags. When placed on the beach, sand can be added to the sandbags, and the sandbags can be placed on the beach or buried in the sand, ensuring stability during use and preventing tilting.

Optimally, the bottom of the sunshade cover is equipped with a base pad, and the upper surface of the base pad is fixedly equipped with edge pads. The edge pads can also be connected to one end of the connecting ropes, providing versatile stability and facilitating efficient use in practice.

The sunshade cover is made of plastic film, and the connecting rod and insertion rod are made of stainless steel pipes.

There are connectors between the crossbar and vertical poles, designed for snap-fit connection.

In contrast to existing technology, this invention offers the following beneficial effects:

This type of beach sunshade achieves a more stable placement by using a crossbar, vertical poles, fasteners, connecting ropes, sandbags, connecting rods, securing rings, and insertion rods.

Initially, the internal installation of a crossbar and vertical poles within the sunshade cover, providing support for its width.

What's more, the external surface of the crossbar allows for the secure attachment of connecting rod, on which the securing ring is firmly fixed. Through the supportive action of the securing ring, the internally fixed insertion rod within the securing ring is inserted into the sand, ensuring initial stability during use and preventing tilting.

By attaching fasteners to the bottom of the vertical poles and using the connected ropes whose another end is equipped with sandbags, you can secure the connected ropes. Once properly connected, sand is placed inside sandbags, which are positioned on the beach to serve as counterweights, further enhancing stability.

This comprehensive approach effectively resolves the challenge of stabilizing the sunshade on the beach, ensuring it remains steady during use, thereby enhancing the user experience and improving overall effectiveness.

It also makes it easy to disassemble and carry by removing the securing screws from the securing rods and U-shaped blocks when needed, offering convenience and reducing the burden on users during transport. This solution efficiently solves the problem of easy setup and stable usage in practical situations.

ATTACHED DIAGRAM EXPLANATION

FIG. 1 is a schematic diagram illustrating the overall novel structure of the present invention.

In the FIGURE: 1, sunshade cover; 2, crossbar; 3, vertical poles; 4, fastenings; 5, connecting ropes; 6, sandbags; 7, connecting rods; 8, securing rings; 9, insertion rods; 10, base pad; 11, edge pads.

SPECIFIC IMPLEMENTATION

The following will provide a clear and complete description of the technical solution in the embodiments of the present invention, with reference to the accompanying drawings. Clearly, the described embodiments are only part of the possible implementations of the invention, not the entirety. Based on the embodiments disclosed in this invention, any other embodiments obtained by those skilled in the art without creative effort are within the scope of protection of this invention.

Please refer to FIG. 1.

A beach sunshade comprises a sunshade cover 1, in which crossbar 2 is internally mounted, with vertical poles 3 fixed at both ends of the crossbar 2. The external surface of the crossbar 2 is fixedly equipped with a connecting rod 7, and the external surface of the connecting rod 7 is fixedly equipped with a securing ring 8 with an insertion rod 9 installed inside the valleys of the securing ring 8. One end of the vertical poles 3 is equipped with a fastener 4, and the inside of the fastener 4 is connected to a connecting rope 5 with one end of the connecting rope 5 connected to sandbags 6. The bottom of the sunshade cover 1 is equipped with a base pad 10 and the upper surface of the base pad 10 is fixedly equipped with edge pads 11. This design ensures that the sunshade does not tilt during use, improving the user's experience and effectiveness, facilitating widespread adoption in practical applications.

The sunshade cover 1 is made of plastic film, and the connecting rod 7 and insertion rod 9 are made of stainless steel pipes. There are connectors between the crossbar 2 and vertical poles 3 designed for snap-fit connection.

In operation, when placing the entire sunshade stably on the beach, the internal installation of the crossbar 2 and vertical poles 3 inside the sunshade cover 1 supports the width and height of the sunshade cover 1. The external surface of the crossbar allows for the secure attachment of a connecting rod. The connecting rod, in turn, firmly hold the securing ring on its surface. This allows the insertion rod 9 to be inserted inside the securing ring 8, ensuring preliminary stability during use. Once inserted, by fixing fasteners 4 at the bottom of vertical poles 3 and using connecting ropes 5 whose another end is equipped with sandbags 6, connecting ropes 5 can be secured, achieving stable connections. After securing, sand can be placed inside sandbags 6, and one end of the connecting rope 5 with sandbags 6 can be placed on the beach, further ensuring stability during placement.

It should be noted that in this document, relational terms such as "first" and "second," and the like, are used solely to distinguish one entity or action from another entity or action, without necessarily requiring or implying any actual relationship or order between them. Additionally, terms such as "comprise," "include," or variations thereof are intended to cover non-exclusive inclusion, such that a process, method, item, or device that includes a series of elements not only includes those elements explicitly listed but also includes other elements inherent to such processes, methods, items, or devices.

Although embodiments of the present invention have been shown and described, those skilled in the art will understand that various changes, modifications, substitutions, and alterations can be made without departing from the principles and spirit of the invention, and such variations are within the scope of protection of the appended claims and their equivalents.

The invention claimed is:

1. A beach sunshade, comprising a sunshade cover (1), wherein an inside of the sunshade cover (1) is structured with a crossbar (2), and one end of two vertical poles (3) are fixedly installed at both ends of the crossbar (2);

wherein, an external surface of the crossbar (2) is fixedly equipped with a connecting rod (7) between the both ends of the crossbar (2), and a securing ring (8) sleeves on an external surface of the connecting rod (7), with an insertion rod (9) being installed inside an aperture of the securing ring (8), wherein an axis of the insertion rod (9) is not in a same line as an axis of the connecting rod (7); and wherein, another end of the two vertical poles (3) away from the crossbar (2) is equipped with two fasteners (4) respectively, and the two fasteners (4) are connected to one end of two connecting ropes (5) respectively, and another end of the two connecting ropes (5) away from the fastener (4) is connected to two sandbags (6) respectively.

2. The beach sunshade according to claim 1, further comprising a base pad (10) arranged under the sunshade cover (1), and an upper surface of four corners of the base pad (10) is fixedly equipped with edge pads (11).

3. The beach sunshade according to claim 1, wherein the sunshade cover (1) is made of plastic film, and the connecting rod (7) and the insertion rod (9) are made of stainless steel pipes.

4. The beach sunshade according to claim 1, further comprising connectors between the crossbar (2) and the vertical poles (3), wherein the crossbar (2) and the vertical poles (3) are designed for snap-fit connection.

* * * * *